US006641458B1

(12) United States Patent
Nofsinger et al.

(10) Patent No.: US 6,641,458 B1
(45) Date of Patent: Nov. 4, 2003

(54) CONFETTI BLASTER

(75) Inventors: Reid Nofsinger, Elgin, IL (US); Mark Grega, Bartlett, IL (US)

(73) Assignee: Strictly FX, Elk Grove Village, IL (US)

( * ) Notice: Subject to any disclaimer, the term of this patent is extended or adjusted under 35 U.S.C. 154(b) by 0 days.

(21) Appl. No.: 10/171,601

(22) Filed: Jun. 14, 2002

(51) Int. Cl.[7] ..... A63H 33/30
(52) U.S. Cl. ..... 446/475; 446/176; 124/74
(58) Field of Search ..... 446/475, 176; 124/74

(56) References Cited

U.S. PATENT DOCUMENTS 6,364,737 B1 * 4/2002 Sterr et al. ..... 446/475

OTHER PUBLICATIONS

Internet website: http://www.teilighting.com, Special Effects Lighting, 2003.*
Internet website: http://www.conwinonline.com, Conwin, Inc., Confetti Cannon Kit, 2000.*
Internet website: http://www.conwinonline.com, Conwin, Inc., Confetti Canon Instruction Sheet, 2000.*
Internet website: http://www.airmagicfx.com, AIRMAGIC Pyrotechnics and Special Effects, 2003.*

* cited by examiner

*Primary Examiner*—Derris H. Banks
*Assistant Examiner*—Urszula M Cegielink
(74) *Attorney, Agent, or Firm*—Michael Best & Friedrich LLC

(57) ABSTRACT

Apparatus and method for separating and replacing a cap from a shank of a tip of a welding electrode. The cap and the shank form a peripheral hollow joint that is defined by a recessed end surface of the shank and a back surface of the cap. The apparatus includes a guide frame having a recessed portion sized for receiving the tip of the welding electrode. The apparatus also includes a cap withdrawing tool movably mounted on the guide frame. The tool has two facing wall sections each having a wedge that is inserted in the peripheral hollow joint. The wedge is forced against the back surface of the cap and removes the cap from the shank by means of a driving mechanism that moves the cap withdrawing tool toward the tip of the welding electrode that is engaged in the recessed portion of the guide frame.

20 Claims, 5 Drawing Sheets

CONFETTI BLASTER

FIELD OF THE INVENTION

The present invention relates to an apparatus and method for separating and replacing a cap from a shank of a tip of a welding electrode.

BACKGROUND OF THE INVENTION

It is known in the art that the electrode caps mounted on shanks of welding robots need to be periodically replaced by new ones because the caps are worn away due to their repeated use. Manually removing the caps is not possible because these are solidly wedged into their shank. Furthermore, the back surface of a cap is typically of only a few millimeters in thickness and therefore a very precise tool must be used.

Known in the art, there is U.S. Pat. No. 4,794,221 (TAKABE) which discloses an apparatus for removing electrode caps. The caps are removed by means of a tool that is inserted in the peripheral hollow joint that is defined between the shank and the cap. The tool is then pivoted downward against the back surface of the cap and the shoulder of the shank. One drawback of this known cap removing tool is that the shoulder of the shank may be damaged and the shank itself be deformed or unaligned as the cap is removed.

Also known in the art, there is U.S. Pat. No. 5,495,663 (SAITO) which discloses an apparatus for removing electrode caps designed to solve the problem of damage to shanks as identified above. The apparatus has two facing shank holders holding the shank from both sides. The apparatus also has electrode cap holders which are moved in a direction parallel to the axis of the shank to remove the cap from the shank by means of tapered sliding surfaces. One drawback of this known cap removing tool is that it requires the use of several components and it therefore does not provide an apparatus and method that can remove a cap from its shank in a simple and efficient manner.

An object of the present invention is therefore to provide an apparatus and method for separating a cap from a welding electrode by means of an apparatus that is simpler and more efficient than those provided in prior art.

SUMMARY OF THE INVENTION

According to the present invention, there is provided an apparatus for separating a cap from a shank of a tip of a welding electrode, said cap and said shank forming a peripheral hollow joint that is defined by a recessed end surface of the shank and a back surface of the cap, the apparatus comprising:

a guide frame having a recessed portion sized for receiving the tip of the welding electrode, said recessed portion extending in a direction perpendicular to said tip and having two facing side walls and an end wall, the side walls having guiding ribs that are inserted in the peripheral hollow joint for guiding the tip of the welding electrode into the recessed portion until the tip of the welding electrode is abutted against the end wall in an engaged position;

a cap withdrawing tool movably mounted on the guide frame, said cap withdrawing tool being movable along a crosswise direction that is perpendicular with respect to both the tip and the recessed portion when the tip of the welding electrode is in the engaged position, said tool having two facing wall sections each having a wedge that is inserted in the peripheral hollow joint when the tool is moved toward the tip of the electrode that is in the engaged position, said wedge being forced against the back surface of the cap for removing the cap from the shank when the tool is moved toward the tip of the electrode; and a driving mechanism coupled to the cap withdrawing tool for moving the cap withdrawing tool toward and away from the tip of the welding electrode along the crosswise direction between an open position where the tip of the electrode is inserted into and removed from the recessed portion of the guide frame and a closed position where the wedge removes the cap from the shank.

According to another aspect of the present invention, there is also provided a method of separating and replacing first and second caps from first and second shanks of first and second tips of welding electrodes, said tips facing each other in a closable clamp arrangement and being held by opposite fingers pivotally mounted on an arm of a welding robot, said caps and said shanks forming first and second peripheral hollow joints that are defined by recessed end surfaces of the shanks and back surfaces of the caps, the method comprising the steps of:

a) inserting the first tip of the first welding electrode of the robot welder, in a first recessed portion of a first guide frame, said first recessed portion extending in a direction perpendicular to said first tip and having two first facing side walls provided with first guiding ribs and a first end wall;

b) guiding the first tip of the first electrode by means of the first guiding ribs of the first side walls that are inserted in the first peripheral hollow joint until the first tip of the first welding electrode is abutted against the first end wall in a first engaged position;

c) detecting that the first tip of the first welding electrode is in the engaged position;

d) moving a first cap withdrawing tool in a closed position, said first tool being mounted on the first guide frame along a first crosswise direction that is perpendicular with respect to both the first tip and the first recessed portion, said first tool having two facing wall sections each having a wedge being inserted in the first peripheral hollow joint and forced against the back surface of the first cap, thereby removing the first cap from the first shank;

e) moving said first cap withdrawing tool in an open position along the crosswise direction and simultaneously actuating an indexing mechanism that moves a first new cap mounted on a first holder of a cap supply drum in a home position;

f) positioning the first and second tips by means of the robot welder in the home position where the first tip is in alignment with the first new cap;

g) closing the first tip against the second tip to insert the first new cap into the first shank of the first tip;

h) inserting the second tip of the second welding electrode, by means of the robot welder, in a second recessed portion of a second guide frame, said second recessed portion extending in a direction perpendicular to said second tip and having two second facing side walls provided with second guiding ribs and a second end wall, said second guide frame being upside down with respect to the first guide frame;

i) guiding the second tip of the electrode by means of the second guiding ribs of the second side walls that are inserted in the second peripheral hollow joint until the second tip of the welding electrode is abutted against the second end wall in a second engaged position;

j) detecting that the second tip of the welding electrode is in the engaged position;

k) moving a second cap withdrawing tool in a closed position, said second tool being mounted on the second guide frame along a second crosswise direction that is perpendicular with respect to both the second tip and the second recessed portion, said second tool having two facing wall sections each having a wedge being inserted in the second peripheral hollow joint and forced against the back surface of the second cap, thereby removing the second cap from the second shank;

l) moving said second cap withdrawing tool in an open position along the crosswise direction and simultaneously actuating the indexing mechanism that moves a second new cap mounted on a second holder of the cap supply drum in the home position;

m) positioning the first and second tips by means of the robot welder in the home position where the second tip is in alignment with the second new cap; and n) closing the second tip against the first tip to insert the second new cap into the second shank of the second tip.

The invention as well as its numerous advantages will be better understood by reading of the following non-restrictive description of a preferred embodiment made in reference to the appending drawings, in which like numerals refer to like elements.

BRIEF DESCRIPTION OF THE DRAWINGS

FIG. 9 is a cross-sectional view taken along line IX—IX of FIG. 3 showing the cap being withdrawn from its shank by means of wedges of the cap withdrawing tool;

FIGS. 10 and 11 are perspective views similar to FIGS. 1 and 2 showing more details of the apparatus for separating a cap from a shank of a tip of a welding electrode with a cap supply drum being removed;

FIG. 12 is a top partly cross-sectional view of FIG. 10 with connectors of the cap supply drum being removed;

FIG. 13 is a partial perspective and exploded view of indexing elements of the cap supply drum;

FIG. 14 is a cross-sectional view taken along line XIV—XIV of FIG. 1 showing more details of the indexing components of the cap supply drum;

FIG. 15 is an exploded view of the indexing components of the cap supply drum shown in FIG. 14;

FIG. 16 is a top schematic view similar to FIG. 1 showing operational steps for removing and replacing the caps of a welding electrode; and FIGS. 17 and 18 are respectively partial top and side views of the cap supply drum shown in FIG. 1 holding new replacement caps.

DETAILED DESCRIPTION OF THE INVENTION

Figure 1:
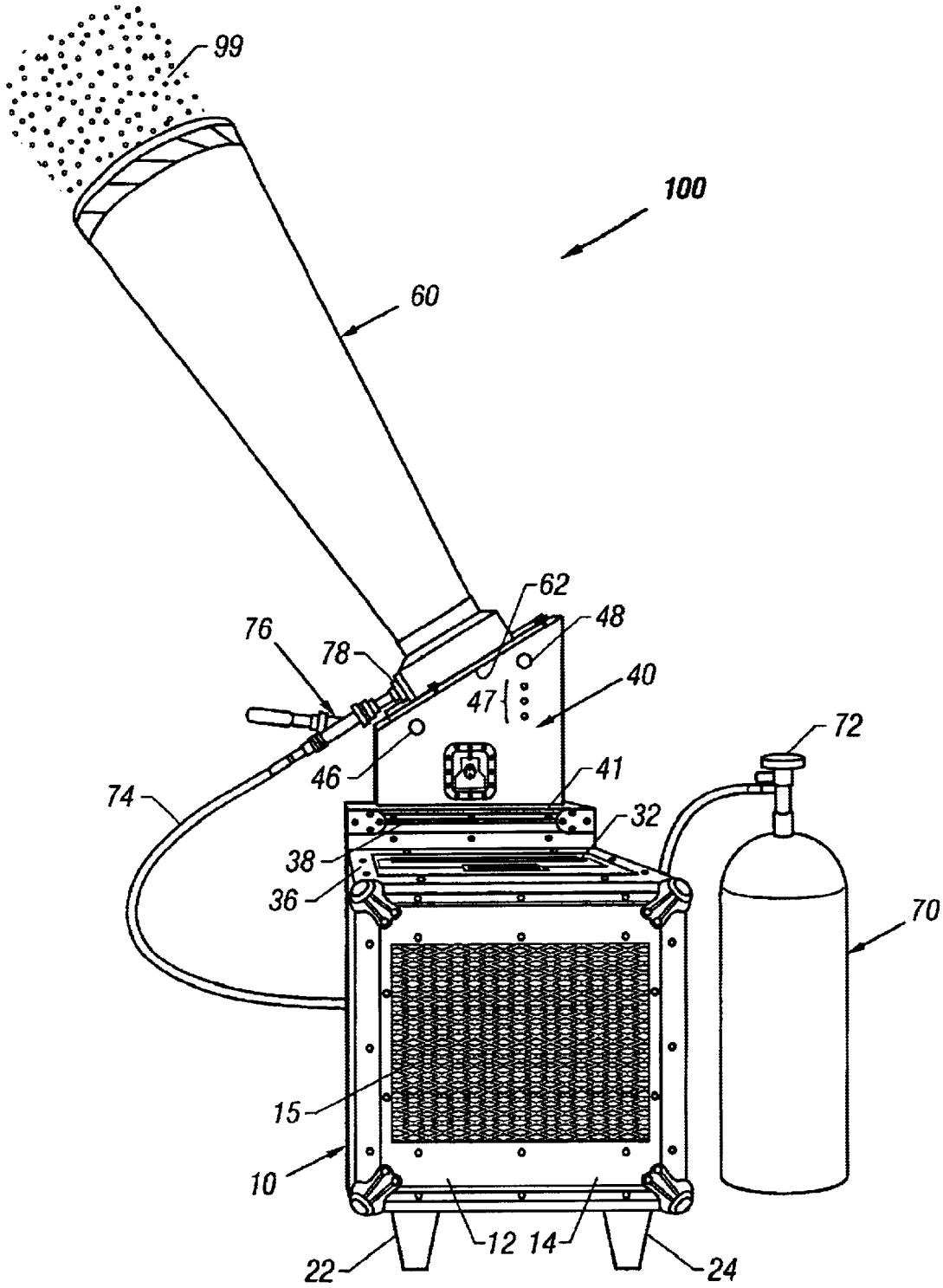
FIG. 1 is a perspective view of an apparatus for separating a cap from a shank of a tip of a welding electrode and for replacing the cap with a new cap, according to a preferred embodiment of the present invention.

Referring to FIG. 1, there is shown a preferred embodiment of an apparatus according to a preferred embodiment of the present invention within the environment in which it operates.

Figure 2:
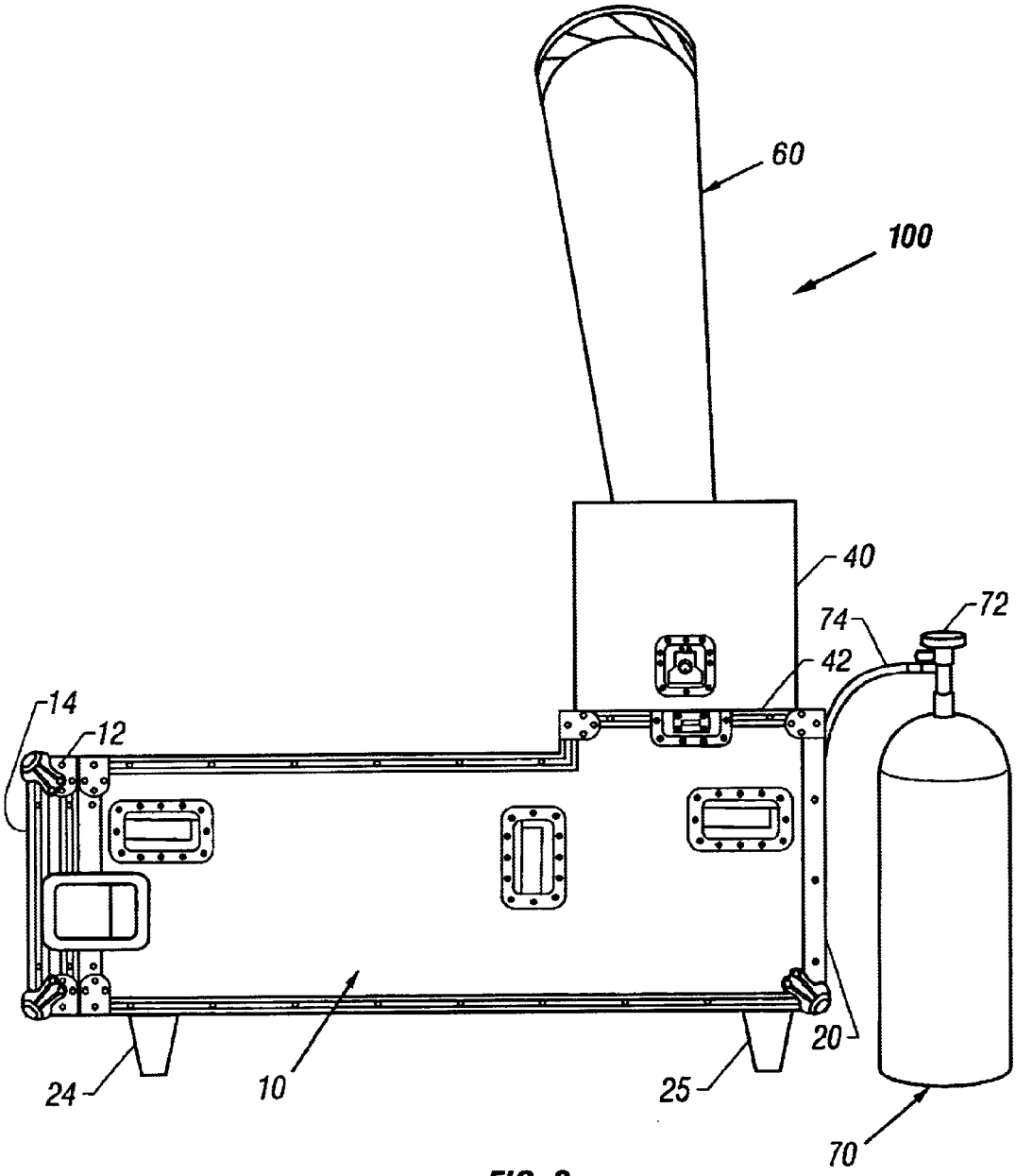
FIG. 2 is a partial perspective view of the tip of a welding electrode to be inserted in a recessed portion of a guide frame with a cap withdrawing tool being in its open position, according to a preferred embodiment of the present invention.

Referring to FIG. 2, the apparatus according to a first aspect of the invention is used for separating a cap 3 from a shank 5 of a tip 7 of a welding electrode. The cap 3 and the shank 5 form a peripheral hollow joint 11 that is defined by a recessed end surface 13 of the shank 5 and a back surface 15 of the cap 3.

Referring back to FIG. 1, a robotic welder, the body of which is not shown, has an arm 10 which preferably holds two fingers 9 and 9' holding the tips 7 and 7' of the welding electrodes that face each other in a closable clamping arrangement. The tips 7, 7' of the welding electrodes are preferably identical to each other. The fingers 9 and 9' are pivotally mounted on a pivot point 12 of the arm 10 so that the robot welder can move them between open and closed positions. It will be understood of course that according to the present invention only one welding electrode may be used instead of the two that are shown.

Referring back to FIG. 2, the apparatus includes a guide frame 17 having a recessed portion 19 sized for receiving the tip 7 of the welding electrode. The recessed portion 19 extends in a direction perpendicular to the tip 7 of the welding electrode and has two facing side walls 21 and an end wall 23. The side walls 21 have guiding ribs 25 (see FIGS. 4 and 5) that are inserted in the peripheral hollow joint 11 for guiding the tip 7 of the welding electrode into the recessed portion 19, along the direction depicted by arrow A, until the tip 7 of the welding electrode is abutted against the end wall 23 in an engaged position.

The apparatus also includes a cap withdrawing tool 27 movably mounted on the guide frame 17. The cap withdrawing tool 27 is movable along a crosswise direction, as depicted by arrow B (see FIG. 3), that is perpendicular with respect to both the tip 7 and the recessed portion 19 when the tip 7 of the welding electrode is in the engaged position, as shown for example in FIGS. 5 and 7. The tool 27 has two facing wall sections 29 each having a wedge 31 that is inserted in the peripheral hollow joint 11 when the tool 27 is moved toward the tip 7 of the electrode that is in the engaged position. When the tool 27 is moved toward the tip 7 of the electrode, as shown for example in FIGS. 6 and 8, the wedge 31 is forced against the back surface 15 of the cap 3 and thereby removes the cap 3 from the shank 5, as shown for example in FIGS. 3 and 9.

Referring to FIGS. 10 and 11, the apparatus also includes a driving mechanism 33 coupled to the cap withdrawing tool 27 for moving the cap withdrawing tool 27 toward and away from the tip 7 of the welding electrode along the crosswise direction between an open position, as shown for example in FIG. 10, where the tip 7 of the electrode is inserted into and removed from the recessed portion 19 of the guide frame 17 and a closed position, as shown for example in FIG. 11, where the wedge 31 removes the cap 3 from the shank 5. Of course, those skilled in the art will understand that many driving mechanisms may be used for moving the cap withdrawing tool 27 back and forth between in its open and closed positions. A hydraulic or pneumatic piston connected to the cap withdrawing tool may be used for example. However, as it will be further described below, the driving mechanism 33 may also serve another purpose of indexing a rotatable cap supply drum 53 (see FIG. 1) that is positioned adjacent to the guide frame 17 and cap withdrawing tool 27.

Figure 8:
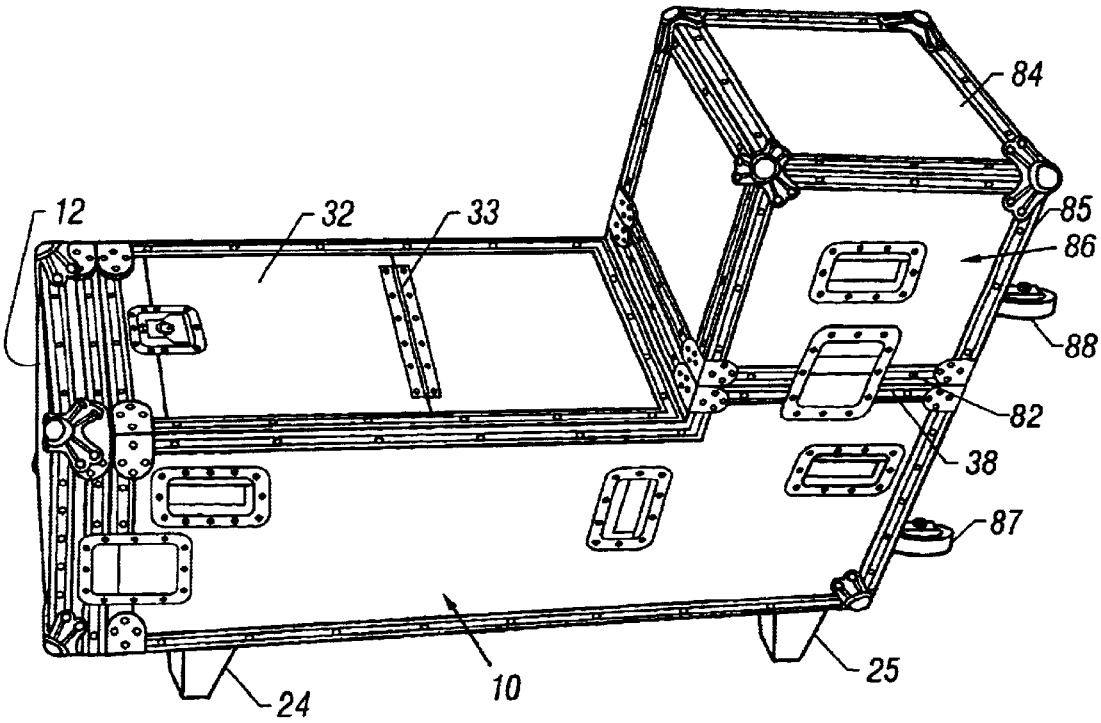
FIG. 8 is a cross-sectional view taken along line VIII—VIII of FIG. 6 showing the cap of the welding electrode being partially removed from its shank by means of wedges provided on the cap withdrawing tool.

Referring to FIG. 8, it is preferable that each wedge 31 be provided with a knife edge 35 that is forced into the back surface 15 of the cap 3 for removing the cap 3 from the shank 5 when the cap withdrawing tool 27 is moved toward the tip 7 of the electrode that is in the engaged position. It is to be noted that if the back surface 15 of the cap 3 is very thin, as is the case for most caps used in the industry, then a cap withdrawing tool that is not provided with a knife edge may not perform satisfactorily to remove the cap. Furthermore, because electrode caps are generally made of copper, which is a soft conducting metal, the problem may be worsened, because using a wedge 31 without a knife edge 35 might crush the thin and soft back surface 15 of the electrode cap 3. This is one of the reasons why knife edges 35 are preferably provided for on the wedges 31. If a knife edge 35 is provided on the wedge 31, it is preferable that it form an angle of about 2 degrees with respect to the back surface 15 of the cap 3 when the tip 7 of the electrode 9 is in the engaged position.

Referring to FIGS. 2 to 6, the wedge 31 preferably has a flat section 37 followed by an angled section 39, which forms an angle of about 17 degrees with respect to the flat section 37. With such a configuration, the wedge 31 is progressively forced against the back surface 15 of the cap 3, without damaging the shoulder of the shank 5. Of course, other suitable angles and configurations may be selected to achieve the same results as it will be understood by those skilled in the art.

Preferably, the guide frame 17 has two parallel grooved channels 43, 43' extending along the crosswise direction and a grooved portion 44 that support the cap withdrawing tool 27. The grooved channels 43, 43' are perpendicular to and intersect the recessed portion 19. Furthermore, the cap withdrawing tool 27 has a complementary shape fitting into the grooved channels 43, 43' for movement thereof along the crosswise direction. Each of the grooved channels 43, 43' has a bottom face 26, 26' that extends all the way to the grooved portion 44. The facing walls 28, 28' of the grooved channels 43, 43' guide the cap withdrawing tool 27 along the crosswise direction as it is moved across the guide frame 17 along the crosswise direction. One of the grooved channels 43 extends across and beyond both side walls 21 of the recessed portion 19 at about a mid portion thereof. The other grooved channel 43' extends tangentially with respect to the end wall 23 of the recessed portion 19. The grooved portion 44 is adjacent to and communicates with the parallel grooved channels 43, 43'. Both grooved channels 43, 43' communicate with each other through a channel 30 extending above and parallel to the recessed portion 19. The channel 30 is sized so as to allow the tip 7 of the electrode to fit therein as it is abutted against the end wall 23. The channel 30 separates two middle portions 32 of the guide frame 17, which are further defined by the grooved channels 43, 43'.

The cap withdrawing tool 27 preferably has a U-shape that defines a recessed section 41 also sized for engaging with the tip 7 of the electrode. The recessed section 41 of the U-shaped cap withdrawing tool 27 is the one that is preferably provided with the facing wall sections 29 and wedges 31.

The driving mechanism 33 is preferably coupled to a proximity sensor 4 directed toward the recessed portion 19 of the guide frame 17 for detecting that the tip 7 of the welding electrode is in the engaged position and sending a signal to the driving mechanism 33 for moving the tool 27 toward the tip 7 of the electrode. It is to be understood that the proximity sensor may be located in a position that is different from the one illustrated. Furthermore, other means may used to determine that the tip 7 of the electrode is in the engaged position, such as for example a position sensor provided on the robot welder that sends the appropriate signals to the driving mechanism for moving the cap withdrawing tool 27 in a suitable manner.

The following portion of the description is now concerned with another aspect of the invention, namely the replacement of the cap 3 with a new cap 54 that is provided on a rotatable cap supply drum 53.

Referring to FIGS. 1, 10 and 11, the guide frame 17 and the cap withdrawing tool 27 both define a first cap withdrawing set 2 that is mounted on a first end of a support plate 40. A second end of the support plate 40 further supports a second cap withdrawing set 2' which is substantially identical to the first cap withdrawing set 2. Both sets 2, 2' face in the same direction toward the robot welder holding the tips 7, 7'. The difference is that the second set 2' is positioned upside down with respect to the first set 2. Both sets are connected to proximity sensors 4, 4'. As will be described further below, the driving mechanism 33 is coupled to both cap withdrawing tools 27 of each set 2, 2'. The reason the second set 2' is in an upside down position is to avoid having to turn the arm 10 of the robot welder upside down when replacing the caps 3, 3'. This feature saves times and therefore improves the efficiency of the apparatus.

The support plate 40 is preferably positioned horizontally and is fixed to a vertical support plate 42. Furthermore, it is preferably to use a xyz compliance positioning system (not shown) connected to the support plate 40 for adjusting and correcting the position of all the elements mounted on the support plate 40 with respect to the robotic welder.

Preferably, each of the cap withdrawing tools 27 has a pin 45 projecting therefrom for cooperating with the driving mechanism 33. The driving mechanism 33 includes a push rod 46 connected to two drive plates 47, 47' by means of a transverse bar 48. Each drive plate 47, 47' has an angled slot 49, 49' slidably receiving the pin 45 of a corresponding cap withdrawing tool 27 for moving the cap withdrawing tools toward and away from the tip 7 of the welding electrode which is in the engaged position in one of the recessed portions 19 or 19'. One of the drive plates 47 has a side slot 51 for indexing a rotatable cap supply drum 53. The push rod 46 is actuated by any suitable means such as a pneumatic motor for example that moves the rod 46 back and forth. Of course, those skilled in the art will understand that this movement must be coordinated with that of the robot welder which is in turn precisely controlled by a program.

The cap supply drum 53 is mounted on the support plate 40 and can only turn in one direction, which in this example is anti-clockwise, so that a new cap 54 to be withdrawn is always present at a home position thereof. The following descriptive portion will explain the details of the indexing mechanism 60 of the support plate 53 (also see FIGS. 13–15). To achieve this result a sprocket wheel 55 is provided with teeth directed in the opposite turning direction. The sprocket wheel is mounted on spacers 58 mounted on the support frame 40. A spring loaded tab 57 engages each of the teeth a time so that the sprocket wheel 55 is blocked from going in an opposite direction. An indexing disk 59 is mounted on the sprocket wheel 55 by means of two pins 61. The indexing disk 59 is made of an outer ring 63 provided with inner cavities 65 disposed all around the ring 63. The distance between the cavities 65 determines the distance by which the cap supply drum 53 is rotated. The indexing disk 59 also has an inner ring 67 positioned within the outer ring 63. The inner ring 67 is provided with spring loaded locking members 69 cooperating with the cavities 65 of the outer ring 63. The outer ring 63 is provided with an indexing tab 71 that is pushed back and forth by the side slot 51 of one of the drive plates 47. Onto the indexing disk 59 is mounted a spacer 73 that is placed under the disk 77. A screw 74 is used to secure the spacer 73 and the indexing disk 59. Another screw 78 is used to secure the spacer 73, the disk 77 and the cap 75 of the cap supply drum 53. The cap supply drum 53 includes a rotatable disk 77 having cap holders 56 extending next to one another around the disk 77 in alternating upside and downside positions. Each cap holder 56 holds a new cap 54 which is positioned in an opposite direction with respect to an adjacent new cap 54'. The cap holders 56 are resiliently biased by means of springs 79.

Figure 3:
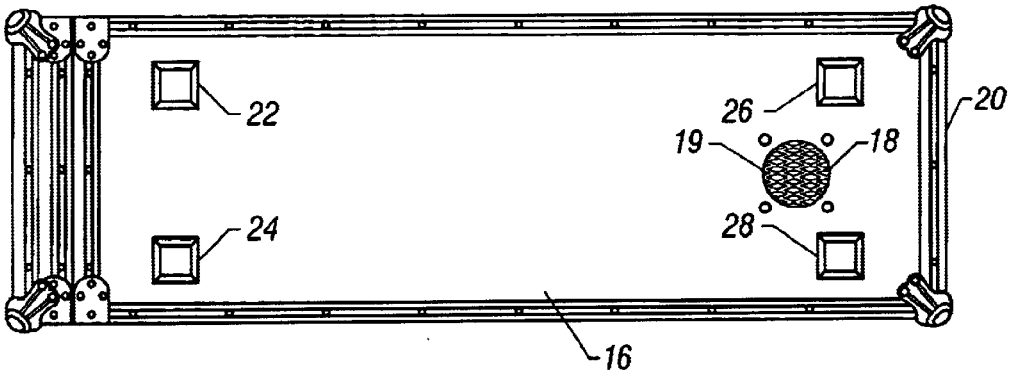
FIG. 3 is a partial perspective view of a cap being withdrawn from its shank by means of the cap withdrawing tool that is in its closed position, according to a preferred embodiment of the present invention.

The following portion of the description will now describe a method of separating and replacing first and second caps 3, 3' from first and second shanks 5, 5' of first and second tips 7, 7' of welding electrodes. As mentioned above the tips 7, 7' face each other in a closable clamp arrangement and are held by opposite fingers 9, 9' pivotally mounted on an arm 10 of a welding robot. Similarly as explained above the caps and the shanks form first and second peripheral hollow joints 11, 11' that are defined by recessed end surfaces 13, 13' of the shanks 5, 5' and back surfaces 15, 15' of the caps 3, 3'. The method according to a preferred embodiment of the present invention comprises the steps of:

a) inserting the first tip 7 of the first welding electrode, as depicted by arrow A of FIG. 16, by means of the robot welder, in a first recessed portion 19 of a first guide frame 17, the first recessed portion extending in a direction perpendicular to the first tip 7 and having two first facing side walls 21 provided with first guiding ribs 25 and a first end wall 23;

b) guiding the first tip 7 of the first electrode by means of the first guiding ribs 25 of the first side walls 21 that are inserted in the first peripheral hollow joint 11 until the first tip 7 of the welding electrode is abutted against the first end wall 23 in a first engaged position;

c) detecting that the first tip 7 of the first welding electrode is in the engaged position;

d) moving a first cap withdrawing tool 27 in a closed position, the first tool 27 being mounted on the first guide frame 17 along a first crosswise direction, as depicted by arrow B of FIG. 3, that is perpendicular with respect to both the first tip 7 and the first recessed portion 19, the first tool 27 having two facing wall sections 29 each having a wedge 31 being inserted in the first peripheral hollow joint 11 and forced against the back surface 15 of the first cap 3, thereby removing the first cap 3 from the first shank 5;

e) moving the first cap withdrawing tool 27 in an open position, as shown for example in FIG. 10, along the crosswise direction and simultaneously actuating an indexing mechanism 60 that moves a first new cap 54 mounted on a first holder 56 of a cap supply drum 53 in a home position, as depicted for example by arrow D of FIG. 16;

f) positioning the first and second tips 7, 7' by means of the robot welder in the home position where the first tip 7 is in alignment with the first new cap 54, as depicted for example by arrow C of FIG. 16;

g) closing the first tip 7 against the second tip 7' to insert the first new cap 54 into the first shank 5 of the first tip 7;

h) inserting the second tip 7' of the second welding electrode, as depicted by arrow A' of FIG. 16, by means of the robot welder, in a second recessed, portion 19' of a second guide frame 17', the second recessed portion 19' extending in a direction perpendicular to the second tip 7' and having two second facing side walls 21' provided with second guiding ribs 25' and a second end wall 23', the second guide frame 17' being upside down with respect to the first guide frame 17;

i) guiding the second tip 7' of the electrode by means of the second guiding ribs 25' of the second side walls 21' that are inserted in the second peripheral hollow joint 11' until the second tip 7' of the welding electrode is abutted against the second end wall 23' in a second engaged position;

j) detecting that the second tip 7' of the welding electrode is in the engaged position;

k) moving a second cap withdrawing tool 27' in a closed position, the second tool 27' being mounted on the second guide frame 17' along a second crosswise direction that is perpendicular with respect to both the second tip 7' and the second recessed portion 19', the second tool 27' having two facing wall sections 28' each having a wedge 31' being inserted in the second peripheral hollow joint 11' and forced against the back surface 15' of the second cap 3', thereby removing the second cap 3' from the second shank 5';

l) moving the second cap withdrawing tool 27' in an open position along the crosswise direction and simultaneously actuating the indexing mechanism 60 that moves a second new cap 54' mounted on a second holder 56' of the cap supply drum 53 in the home position, as depicted for example by arrow D of FIG. 16;

m) positioning the first and second tips 7, 7' by means of the robot welder in the home position where the second tip 7' is in alignment with the second new cap 54', as depicted for example by arrow C' of FIG. 16; and n) closing the second tip 7' against the first tip 7 to insert the second new cap 54' into the second shank 5' of the second tip 7'.

The apparatus and method for separating a cap from a welding electrode and replacing the cap with a new cap according to the present invention are simpler and more efficient than those provided in prior art. Indeed, only a single actuator is needed to simultaneously perform both functions of removing a cap from its electrode and automatically indexing of a cap supply drum. The apparatus and method are thus easily integrated in industrial plants, such as in automobile factories, which tend to be more and more completely automated.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. Apparatus for separating a cap from a shank of a tip of a welding electrode, said cap and said shank forming a peripheral hollow joint that is defined by a recessed end surface of the shank and a back surface of the cap, the apparatus comprising:

a guide frame having a recessed portion sized for receiving the tip of the welding electrode, said recessed portion extending in a direction perpendicular to said tip and having two facing side walls and an end wall, the side walls having guiding ribs that are inserted in the peripheral hollow joint for guiding the tip of the welding electrode into the recessed portion until the tip of the welding electrode is abutted against the end wall in an engaged position;

a cap withdrawing tool movably mounted on the guide frame, said cap withdrawing tool being movable along a crosswise direction that is perpendicular with respect to both the tip and the recessed portion when the tip of the welding electrode is in the engaged position, said tool having two facing wall sections each having a wedge that is inserted in the peripheral hollow joint when the tool is moved toward the tip of the electrode that is in the engaged position, said wedge being forced against the back surface of the cap for removing the cap from the shank when the tool is moved toward the tip of the electrode; and a driving mechanism coupled to the cap withdrawing tool for moving the cap withdrawing tool toward and away from the tip of the welding electrode along the crosswise direction between an open position where the tip of the electrode is inserted into and removed from the recessed portion of the guide frame and a closed position where the wedge removes the cap from the shank.

2. The apparatus according to claim 1, wherein each wedge of the facing wall sections of the cap withdrawing tool has a knife edge that is forced into the back surface of the cap for removing the cap from the shank when the tool is moved toward the tip of the electrode that is in the engaged position.

3. The apparatus according to claim 2, wherein the knife edge forms an angle of about 2 degrees with respect to the back surface of the cap when the tip of the electrode is in the engaged position.

4. The apparatus according to claim 1, wherein the wedge has a flat section and an angled section forming an angle of about 17 degrees with respect to the flat section.

5. The apparatus according to claim 2, wherein the guide frame has two parallel grooved channels extending along the crosswise direction and a grooved portion supporting the cap withdrawing tool, the grooved channels being perpendicular to and intersecting with the recessed portion, and wherein the cap withdrawing tool has a complementary shape fitting into said parallel grooved channels for movement thereof along said crosswise direction.

6. The apparatus according to claim 5, wherein the complementary shape of the cap withdrawing tool has a U-shape comprising a recessed section sized for engaging with the tip of the electrode when in the engaged position.

7. The apparatus according to claim 2, wherein the driving mechanism is coupled to a proximity sensor directed toward the recessed portion of the guide frame for detecting that the tip of the welding electrode is in the engaged position and sending a signal to the driving mechanism for moving the tool toward the tip of the electrode.

8. The apparatus according to claim 2, wherein the apparatus is further for separating a second cap of a tip of an electrode facing said other tip in a closable clamp arrangement, said tips being held by opposite fingers pivotally mounted on an arm of a welding robot, and wherein the guide frame and the cap withdrawing tool both define a first cap withdrawing set mounted on a first end of a support plate, a second end of the support plate further supporting a second cap withdrawing set substantially identical to said first cap withdrawing set, both sets having their recessed portions facing in a same direction and said second set being positioned upside down with respect to the first set, said driving mechanism being coupled to the cap withdrawing tools of each set.

9. The apparatus according to claim 8, wherein each of the cap withdrawing tools of each set has a pin projecting therefrom, and the driving mechanism comprises a push rod that is connected to a pair of drive plates, each drive plate having an angled slot slidably receiving the pin of a corresponding cap withdrawing tool for moving both cap withdrawing tools of each set toward and away from one of said tips being in the engaged position, one of said drive plates having a side slot for indexing a cap supply drum.

10. The apparatus according to claim 9, wherein the cap supply drum comprises a unidirectional indexing mechanism having an indexing tab engaging with the side slot of said one of the drive plates for rotating the cap supply drum by a step movement when moving the push rod in one direction.

11. The apparatus according to claim 10, wherein the cap supply drum comprises a rotatable disk having cap holders extending next to one another around said disk in alternating upside and downside positions, each holder holding a new cap which is positioned in an opposite direction with respect to an adjacent new cap.

12. Method of separating and replacing first and second caps from first and second shanks of first and second tips of welding electrodes, said tips facing each other in a closable clamp arrangement and being held by opposite fingers pivotally mounted on an arm of a welding robot, said caps and said shanks forming first and second peripheral hollow joints that are defined by recessed end surfaces of the shanks and back surfaces of the caps, the method comprising the steps of:

a) inserting the first tip of the first welding electrode, by means of the robot welder, in a first recessed portion of a first guide frame, said first recessed portion extending in a direction perpendicular to said first tip and having two first facing side walls provided with first guiding ribs and a first end wall;

b) guiding the first tip of the first electrode by means of the first guiding ribs of the first side walls that are inserted in the first peripheral hollow joint until the first tip of the first welding electrode is abutted against the first end wall in a first engaged position;

c) detecting that the first tip of the first welding electrode is in the engaged position;

d) moving a first cap withdrawing tool in a closed position, said first tool being mounted on the first guide frame along a first crosswise direction that is perpendicular with respect to both the first tip and the first recessed portion, said first tool having two facing wall sections each having a wedge being inserted in the first peripheral hollow joint and forced against the back surface of the first cap, thereby removing the first cap from the first shank;

e) moving said first cap withdrawing tool in an open position along the crosswise direction and simultaneously actuating an indexing mechanism that moves a first new cap mounted on a first holder of a cap supply drum in a home position;

f) positioning the first and second tips by means of the robot welder in the home position where the first tip is in alignment with the first new cap;

g) closing the first tip against the second tip to insert the first new cap into the first shank of the first tip;

h) inserting the second tip of the second welding electrode, by means of the robot welder, in a second recessed portion of a second guide frame, said second recessed portion extending in a direction perpendicular to said second tip and having two second facing side walls provided with second guiding ribs and a second end wall, said second guide frame being upside down with respect to the first guide frame;

i) guiding the second tip of the electrode by means of the second guiding ribs of the second side walls that are inserted in the second peripheral hollow joint until the second tip of the welding electrode is abutted against the second end wall in a second engaged position;

j) detecting that the second tip of the welding electrode is in the engaged position;

k) moving a second cap withdrawing tool in a closed position, said second tool being mounted on the second guide frame along a second crosswise direction that is perpendicular with respect to both the second tip and the second recessed portion, said second tool having two facing wall sections each having a wedge being inserted in the second peripheral hollow joint and forced against the back surface of the second cap, thereby removing the second cap from the second shank;

l) moving said second cap withdrawing tool in an open position along the crosswise direction and simultaneously actuating the indexing mechanism that moves a second new cap mounted on a second holder of the cap supply drum in the home position;

m) positioning the first and second tips by means of the robot welder in the home position where the second tip is in alignment with the second new cap; and n) closing the second tip against the first tip to insert the second new cap into the second shank of the second tip.

13. The method according to claim 12, wherein each wedge of the wall sections of the first and second tools are provided with a knife edge.

14. The method according to claim 13, wherein each said knife edge forms an angle of about 2 degrees with respect to one of said first and second tips that is in the engaged position.

15. The method according to claim 12, wherein each wedge has a flat section and an angled section forming an angle of about 17 degrees with respect to the flat section.

16. The method according to claim 13, wherein each of said guide frames has two parallel grooved channels extending along each of said crosswise directions and a grooved portion supporting each of said cap withdrawing tools, the grooved channels being perpendicular to and intersecting with each of said recessed portions, and wherein each of said cap withdrawing tools has a complementary shape fitting into the parallel grooved channels for movement thereof along each of said crosswise directions.

17. The method according to claim 16, wherein the complementary shape of each of said cap withdrawing tools has a U-shape comprising a recessed section sized for engaging with each of said tips when in the engaged position.

18. The method according to claim 12, wherein steps c) and j) are carried out by means of first and second proximity sensors directed toward each of said recessed portions of the guide frames for detecting that each said tip is in the engaged position.

19. The method according to claim 12, wherein the cap supply drum comprises a rotatable disk having cap holders extending next to one another around said disk in alternating upside and downside positions, said cap holders holding new caps to be inserted in said first and second tips.

20. Apparatus for separating a cap from a shank of a tip of a welding electrode, said cap and said shank forming a peripheral hollow joint that is defined by a recessed end surface of the shank and a back surface of the cap, the apparatus comprising:

a guide frame having a recessed portion sized for receiving the tip of the welding electrode, said recessed portion extending in a direction perpendicular to said tip and having two facing side walls and an end wall, the side walls having guiding ribs that are inserted in the peripheral hollow joint for guiding the tip of the welding electrode into the recessed portion until the tip of the welding electrode is abutted against the end wall in an engaged position;

a cap withdrawing tool movably mounted on the guide frame, said cap withdrawing tool being movable along a crosswise direction that is perpendicular with respect to both the tip and the recessed portion when the tip of the welding electrode is in the engaged position, said tool having two facing wall sections each having a wedge provided with a knife edge that is inserted in the peripheral hollow joint when the tool is moved toward the tip of the electrode that is in the engaged position, said knife edge of the wedge being forced into the back surface of the cap for removing the cap from the shank when the tool is moved toward the tip of the electrode; and a driving mechanism coupled to the cap withdrawing tool for moving the cap withdrawing tool toward and away from the tip of the welding electrode along the crosswise direction between an open position where the tip of the electrode is inserted into and removed from the recessed portion of the guide frame and a closed position where the wedge removes the cap from the shank.

* * * * *

UNITED STATES PATENT AND TRADEMARK OFFICE

CERTIFICATE OF CORRECTION

PATENT NO. : 6,641,458 B1
DATED : November 4, 2003
INVENTOR(S) : Nofsinger et al.

It is certified that error appears in the above-identified patent and that said Letters Patent is hereby corrected as shown below:

Please replace old specification with new specification.

Signed and Sealed this

First Day of March, 2005

JON W. DUDAS
*Director of the United States Patent and Trademark Office*

(12) United States Patent
Nofsinger et al.

(10) Patent No.: US 6,641,458 B1
(45) Date of Patent: Nov. 4, 2003

(54) CONFETTI BLASTER

(75) Inventors: Reid Nofsinger, Elgin, IL (US); Mark Grega, Bartlett, IL (US)

(73) Assignee: Strictly FX, Elk Grove Village, IL (US)

( * ) Notice: Subject to any disclaimer, the term of this patent is extended or adjusted under 35 U.S.C. 154(b) by 0 days.

(21) Appl. No.: 10/171,601

(22) Filed: Jun. 14, 2002

(51) Int. Cl.[7] ..... A63H 33/30
(52) U.S. Cl. ..... 446/475; 446/176; 124/74
(58) Field of Search ..... 446/475, 176; 124/74

(56) References Cited

U.S. PATENT DOCUMENTS 6,364,737 B1 * 4/2002 Sterr et al. ..... 446/475

OTHER PUBLICATIONS

Internet website: http://www.teilighting.com, Special Effects Lighting, 2003.*

Internet website: http://www.conwinonline.com, Conwin, Inc., Confetti Cannon Kit, 2000.*

Internet website: http://www.conwinonline.com, Conwin, Inc., Confetti Cannon Instruction Sheet, 2000.*

Internet website: http://www.airmagicfx.com, AIRMAGIC Pyrotechnics and Special Effects, 2003.*

* cited by examiner

*Primary Examiner*—Derris H. Banks
*Assistant Examiner*—Urszula M Cegielnik
(74) *Attorney, Agent, or Firm*—Michael Best & Friedrich LLC

(57) ABSTRACT

A confetti blaster useful for delivering a barrage of confetti includes a horizontally-oriented feed zone with separate atmospheric inlets for an entrainment gas stream and a transport gas stream, wherein the entrainment gas stream acts generally parallel to the force of gravity to minimize settling problems in the feed zone and a positive displacement loading port is provided to limit the amount of confetti that may be introduced into the feed zone at one time.

20 Claims, 5 Drawing Sheets

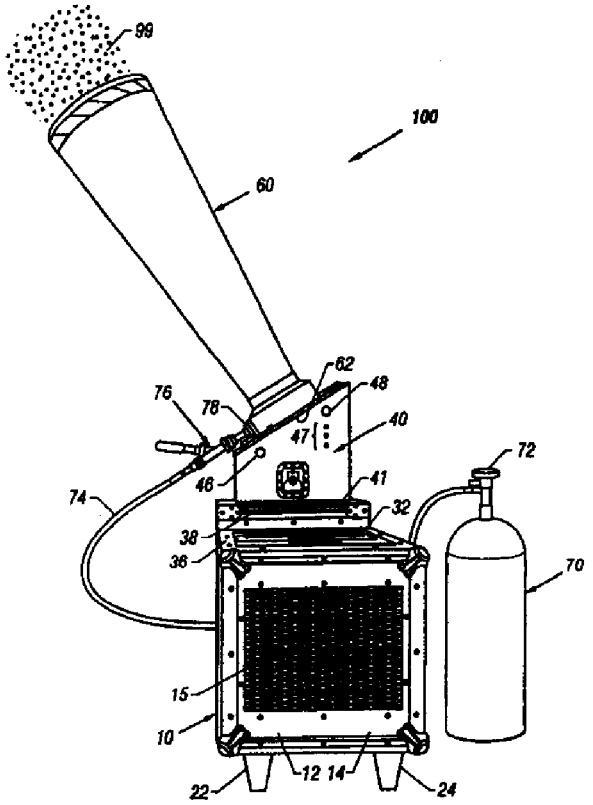

CONFETTI BLASTER

TECHNICAL FIELD

This invention generally relates to a device for broadcasting confetti. More specifically, the invention relates to a confetti blaster for delivering a barrage of confetti, and to methods for its construction and use.

BACKGROUND OF THE INVENTION

Loft, coverage and distance are key factors for delivering a successful confetti barrage. Of these, distance is the most important. Distance permits the blaster operator to send his confetti higher for longer hang-time. Distance permits the operator to bombard a larger area with more consistent coverage. Of course, successful confetti blasting also requires consistently reliable operation in order to deliver the barrage at the appointed time. For the present purposes, "confetti" means bits of paper, tissue, plastic, rubber, foam, or other material for scattering in celebration or as entertainment.

Previously disclosed confetti cannons are useful for providing a single discharge of confetti. The confetti cannon is essentially a tube filled with confetti and discharged by a burst of a compressed gas, usually air. Because confetti canons are relatively simple and compact, they are commonly employed at an elevated location, for example, from the rigging above a stage where performers are entertaining. However, a single confetti cannon cannot provide a continuous barrage of confetti. Also, the use of compressed air limits the range of the confetti cannon.

A conventional confetti blaster is discharged by an eductor in order to provide a more sustained confetti delivery. The eductor uses momentum from a fast moving gas stream, termed "motive gas", to accelerate a volume of lower pressure gas, such as atmospheric air. This acceleration creates a negative pressure or vacuum, inducing the lower pressure gas to flow toward the vacuum or low pressure inlet of the eductor. Typically, carbon dioxide is utilized as the motive gas. Once inside the eductor, the motive gas and the lower pressure gas are intermixed and discharged through an ejection section outlet.

The conventional confetti blaster has two distinct operating stages or legs. One leg is a down-flow storage volume. Confetti is loaded into the storage leg, and settles under the influence of gravity. Additionally, when motive gas is supplied to the eductor, vacuum generated by the eductor induces atmospheric air to flow through an inlet port at the top of the storage leg, and down through the settled confetti in the storage leg. This down-flow of air through the storage leg creates a pressure differential pressure, which also tends to promote settling in the storage leg.

The other leg of the conventional confetti blaster is an up-flow transport leg, which moves atmospheric air and confetti from the storage leg to the low pressure inlet of the eductor. Only a very brief and abrupt transition zone exists, if any, between the down-flow storage leg and the up-flow transport leg of the conventional confetti blaster.

Because gravity and the down-flow of air work together to promote confetti settling in the storage leg, the conventional confetti blaster is prone to plugging, often at the most embarrassing moments. Settled confetti in the storage leg must be fluffed or expanded before it can be made to flow smoothly out of the storage leg and on to the eductor. While settling may sometimes be overcome by supplying more or higher pressure motive gas to the eductor, this is an inefficient way to operate and wastes energy that could be better utilized to produce loft, coverage and distance.

Another problem with the conventional confetti blaster is that it is typically loaded through a recloseable charging port located at the top of the storage leg. Inexperienced operators tend to overload the storage leg with confetti or, even worse, compress the confetti in a misguided attempt to fit more confetti in the storage leg. Overloading and compressing further aggravate the plugging problem.

Because space is usually in high demand close by stages and arenas where confetti barrages are scheduled, footprint and versatility are important considerations. However, the conventional confetti blaster occupies a relatively large footprint for the amount of confetti it discharges. Also, the entire body of the conventional confetti blaster must be rotated in order to change its direction of discharge.

Therefore, a need exists for an improved confetti blaster that is capable of producing more loft, coverage and distance from a given source of motive power. Preferably, the improved confetti blaster is more reliable and less prone to plugging. Ideally, the discharge of the improved confetti blaster can be adjusted to discharge in any direction without rotating its entire body.

SUMMARY OF THE INVENTION

The invention provides an improved confetti blaster that includes an air mover and a horizontally-oriented feed zone with separate atmospheric inlets for an entrainment gas stream and a transport gas stream. The entrainment gas stream acts generally parallel to the force of gravity, to alleviate any confetti settling problems in the feed zone. The air mover of the improved confetti blaster is incrementally rotatable, so that the direction of discharge of the confetti blaster may be varied independently of the location of its body. The improved confetti blaster includes a positive displacement loading port, which limits the amount of confetti that may be introduced into the feed zone at one time.

In a preferred aspect, the invention is a confetti blaster that includes an air mover, a generally vertical wall and a generally horizontal wall. The air mover is capable of operating at a predetermined volumetric capacity while generating a predetermined degree of vacuum at the air mover's low pressure inlet. The vertical wall substantially surrounds a transport zone having a flow path to the low pressure inlet. An atmospheric air inlet passes through the vertical wall, situated and sized to produce a substantially vertical flow of air through the transport zone at conditions effective to transport confetti under the influence of the vacuum.

The horizontal wall substantially surrounds a horizontally-oriented entrainment zone having a flow path to the low pressure inlet. An atmospheric air inlet passes through the horizontal wall, situated and sized to produce a substantially horizontal flow of air through the transport zone at conditions effective to entrain confetti under the influence of the vacuum.

In another preferred aspect, the invention includes an air mover as described above and a horizontally-oriented feed box. The feed box has an inlet end, an outlet end, opposite sides, a top, and a bottom. The feed box communicates with the surrounding air via a transport air inlet port at or near the outlet end, and an entrainment air inlet port at or near the inlet end. Because the transport air inlet port and the entrainment air inlet port each have flow paths to the low pressure inlet of the air mover, they operate under the influence of the vacuum. The transport air inlet is situated and sized to produce a substantially vertical flow of air through the transport zone at conditions effective to transport confetti. The entrainment air inlet is situated and sized to produce substantially horizontal flow of air through the transport zone at conditions effective to entrain confetti.

The air mover is preferably an eductor, employing carbon dioxide as the motive gas. The eductor is incrementally rotatable relative to the feed box.

The feed box forms a charging port that is recloseably sealed by a lid. The lid is pivotally attached to the top of the feed box by a hinge. Preferably, a limiting plate projects from the lid and extends beyond the hinge, so that raising the lid lowers the limiting plate into the feed box.

BRIEF DESCRIPTION OF THE DRAWINGS

Figure 4:
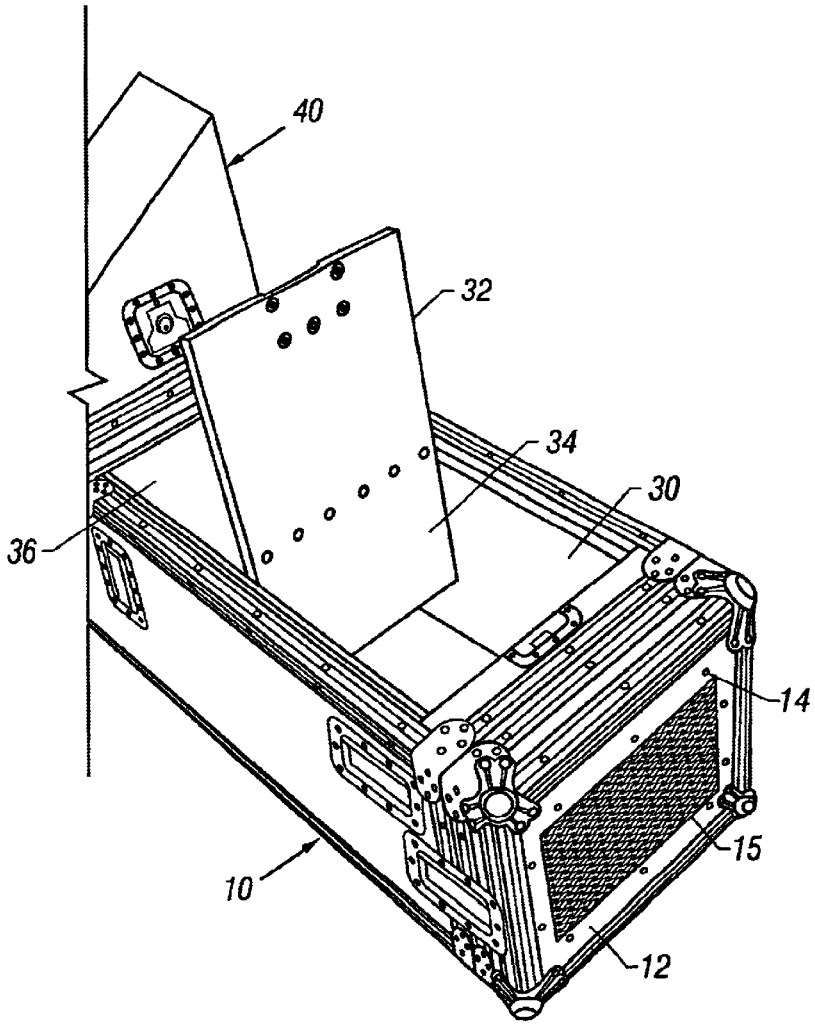
FIG. 4 is a cross-sectional view of the guide frame and cap withdrawing tool taken along line IV—IV of FIG. 2.
Figure 5:
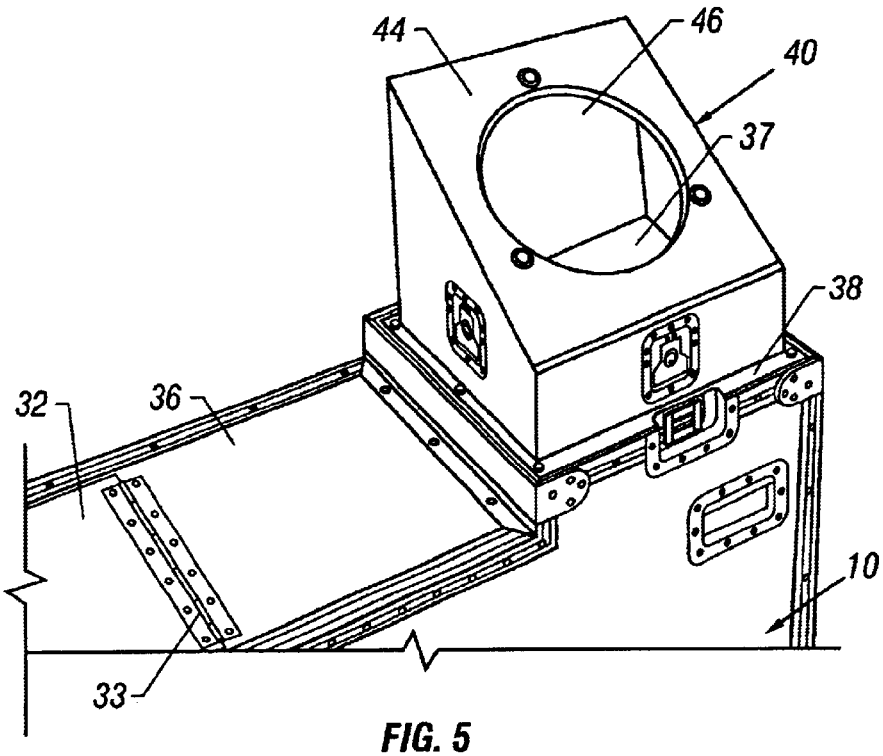
FIG. 5 is a cross-sectional view similar to FIG. 4 with the tip of the welding electrode being inserted in a recessed portion of the guide frame in an engaged position.
Figure 6:
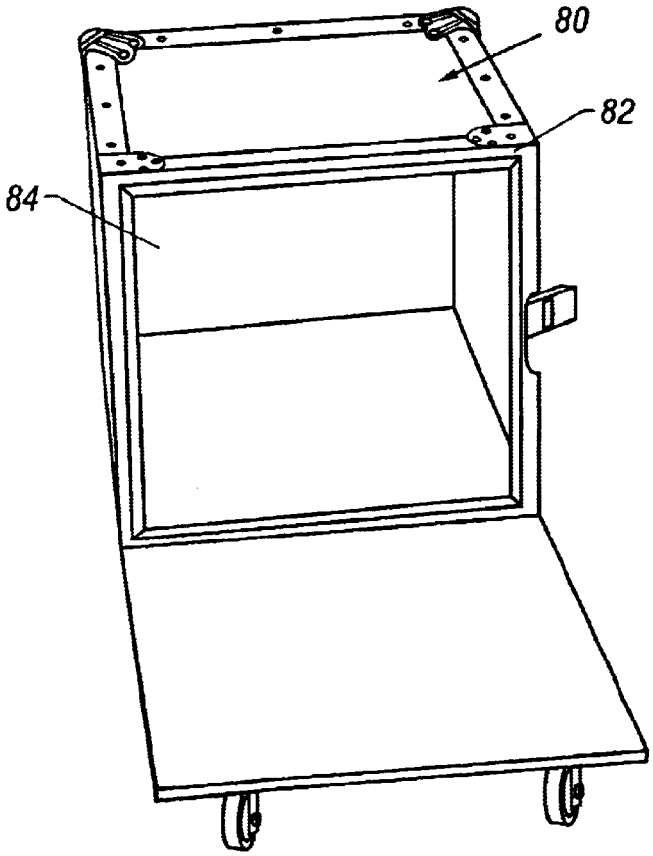
FIG. 6 is cross-sectional view similar to FIG. 4 with the cap of the welding electrode being partially removed from its shank by means of wedges provided on the cap withdrawing tool.
Figure 7:
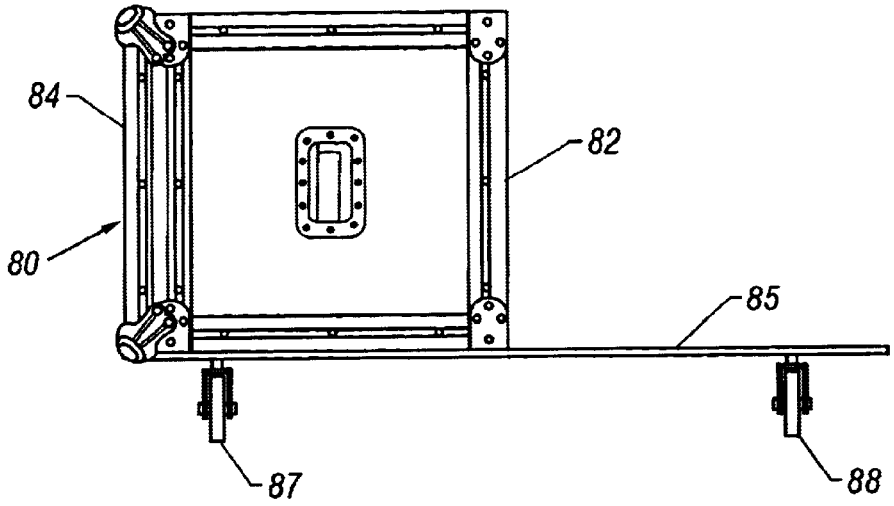
FIG. 7 is a cross-sectional view taken along line VII—VII of FIG. 5 showing the tip of the welding electrode being inserted in the recessed portion of guide frame.

FIG. 1 is a perspective view of confetti blaster 100 in operation, in accordance with the invention;

FIG. 2 is a perspective view of confetti blaster 100 in standby mode;

FIG. 3 is a bottom plan view of confetti blaster 100, showing transport air inlet 18;

FIG. 4 is a partial perspective view of confetti blaster 100, with lid 32 raised and limiting plate 34 lowered to discourage overcharging;

FIG. 5 is a partial perspective view of confetti blaster 100, showing duct 40 attached to feed box 10;

FIG. 6 is a perspective view of travelling cover 80;

FIG. 7 is a side elevation view of travelling cover 80, showing wheels 88–89; and FIG. 8 is a perspective view of travelling cover 80 attached to feed box 10.

DETAILED DESCRIPTION OF PREFERRED ASPECTS OF THE INVENTION

In a preferred embodiment, the invention is a confetti blaster such as confetti blaster 100, depicted in FIG. 1. Blaster 100 includes feed box 10, eductor 60 and motive gas cylinder 70. Confetti 99 is ejected from eductor 60, along with atmospheric air and spent motive gas.

As depicted in FIGS. 2 and 4, inlet end 12 of feed box 10 defines entrainment air inlet port 15. Grating 14 covers entrainment air inlet port 15 to prevent confetti from escaping. Grating 14 also prevents foreign objects above a certain size from entering.

As shown in FIG. 3, transport air inlet port 18 is located in bottom 16 of feed box 10, adjacent outlet end 20 and directly below inlet aperture 42 of duct 40 and inlet 62 of eductor 60. Transport air grating 19 covers transport air inlet port 18. Also shown in FIG. 3 are rubber support posts 22, 24, 26 and 28 mounted on bottom 16.

Top 36 of feedbox 10 defines charge port 30, best seen in FIG. 4. Lid 32 is pivotally attached by hinge 33 to top 36 so as to cover charge port 30 when lid 32 is lowered onto top 36. Relatively soft foam material surrounds charge port 30 to facilitate sealing between lid 32 and top 36. Lid 32 is raised to add confetti to feedbox 10. As can be seen in FIG. 4, limiting plate 34 projects from and extends beyond lid 32 into feedbox 10. When lid 32 is raised, limiting plate 34 descends to effectively limit the volume of confetti that can be charged into feedbox 10.

Referring now to FIG. 5, a raised portion 38 of top 36 defines opening 37. When duct 40 is attached to raised portion 38, duct 40 surrounds opening 37. Duct 40 includes inlet end 41, which defines inlet aperture 42. Duct 40 also includes tapered outlet end 44, which defines outlet aperture 46. Duct 40 provides a relatively free flow path from opening 37 to aperture 36, while isolating this flow path from the atmosphere outside duct 40. Tapered outlet end 44 is adapted for mating with low pressure inlet 62 of eductor 60. Inlet aperture 42 and outlet aperture 46 are surrounded with soft, high-density foam material to promote sealing.

Duct 40 is removably attached to raised portion 38 of top 36. Mating portions of raised portion 38 and inlet end 41 are formed in the shape of complementary polyhedrons, preferably cubes. This mating arrangement permits duct 40, and eductor 60, to be mounted with outlet end 44 canted toward any one of a plurality of directions, relative to feedbox 10, and rotated incrementally between these directions without moving feed box 10.

Tapered outlet end 44 is relatively flat and pivotally attached to duct 40 by axle 46, so that the angle between tapered outlet end 44 and inlet end 41 is adjustable. With duct 40 mounted on raised portion 38, tapered outlet end 44 is swiveled to a desired angle of elevation and a pin 48 is inserted into one of elevation holes 47 to secure the angle. In this manner, the distance and loft of confetti blaster 100 is adjusted. A synthetic rubber bellows seal between tapered outlet end 44 and duct 40 minimizes atmospheric air leakage into duct 40.

As depicted in FIGS. 1 and 2, eductor 60 is a venturi-type air mover, also known as an eductor or ejector, of the type commercially available from Texas Pneumatic Tools, Inc. of Reagan, Tex. Eductor 60 may be operated with pressurized carbon dioxide, nitrogen, air or other gases as the motive gas. Of these, carbon dioxide stored in cylinder 70 at a gauge pressure of about 800 pounds per inch is preferred.

Also depicted in FIGS. 1 and 2, confetti Blaster 100 is provided with cylinder 70 containing carbon dioxide in liquid and gas phases. Siphon tube 72 is equipped with a shut-off valve for starting and stopping the flow of carbon dioxide from cylinder 70. Hose 74 conducts the motive gas from siphon tube 72 through a throttling valve 76 into motive gas inlet 78 of eductor 60. Inside eductor 60, the motive gas enters a venturi nozzle (not shown), which generates a vacuum at low pressure inlet 62.

Although carbon dioxide has been referred to as a gas, those skilled in this art will appreciate that siphon tube 72 may draw either gas or liquid from the bottom of cylinder 70. When siphon 72 draws liquid from cylinder 70, this liquid carbon dioxide boils to produce carbon dioxide vapor in hose 74 or eductor 60.

The degree of vacuum and the volumetric rate capacity of eductor 60 are functions of the motive gas composition, supply rate and supply pressure. These functions, and methods for predicting these functions, are well known to those skilled in the art.

The size and placement of entrainment air inlet 15 and transport air in let 18 relative to feedbox 10 and eductor 60, affect the operation of confetti blaster 100. One satisfactory arrangement is provided below as an example. It is expected that this arrangement will suggest many other satisfactory arrangements, all of which are intended to be included within the scope of the present invention. This example is not limiting. The scope of the invention is limited only by the appended claims.

As an example, entrainment air inlet 15 is rectangular, with a width of about 20 inches and a height of about 16 inches. The center of entrainment air inlet 15 is located about 22 inches below the center line of low pressure inlet 62. The cross-sectional area of the entrainment zone associated with entrainment air inlet 15 is about 160 square inches.

In the same example, transport air inlet 18 is about 4 inches in diameter and located about 30 inches below and on the center line of low pressure inlet 62. The cross-sectional area of the transport zone associated with transport air inlet 18 is about 220 square inches. The total rate of atmospheric air drawn through entrainment air inlet 15 and transport air inlet 18 is about 5000 standard cubic feet per minute.

Duct 40 and feedbox 10 are in pneumatic communication with the venturi nozzle and are influenced by the vacuum at low pressure inlet 62. Under the force of this vacuum, ambient air is drawn through entrainment air inlet 15 and carried horizontally along feedbox 10 to expand and entrain at least a portion of any confetti, which is present in feedbox 10.

The action of the vacuum at low pressure inlet 62 also draws ambient air through transport air grid 19 and creates a vertical stream of relatively fast-moving air within feedbox 10. This stream further expands and transports confetti upwardly through duct 40 and into low pressure inlet 62. Inside the venturi nozzle (not shown) of eductor 60, confetti and air mix with the motive gas, and are forcefully ejected from eductor 60.

Referring now to FIGS. 6, 7 and 8, travelling cover 80 is suitable for mounting on raised portion 38 when eductor 60 has been removed. The purpose of travelling cover 80 is to facilitate transportation of feed box 10. Open end 82 of travelling cover 80 is sized to surround duct 40, with closed end 84 fitting over and protecting duct 40. A clamp secures travelling cover 80 to raised portion 38.

Support plate 85 extends from travelling cover 80 and substantially covers outlet end 20 of feed box 10. Support plate 85 may be fabricated from, for example, three-quarter inch plywood. Wheels 86, 87, 88 and 89 are mounted on support plate 85, so that feed box 10 may be flipped on end and wheeled away with travelling cover 80 clamped in place, as seen in FIG. 8.

FIG. 8 also shows that confetti blaster 100 is correctly configured for mating with another, identical confetti blaster and travelling cover. Because several confetti blasters are often used for a single performance, and then transported simultaneously to a different location, this mating capability of confetti blaster 100 is useful and convenient.

As shown in FIG. 4, for example, inlet end 12 of feed box 10 is removably secured by a clamp. Inlet end 12 may be removed to permit eductor 60 to be placed inside feed box 10 for transportation. Inlet end 12 is then clamped securely, and feed box 10 and eductor 60 may be safely and conveniently transported.

Confetti blaster 100 is intended for use with any and all confetti. Preferably, confetti blaster 100 is used with confetti which is entrained by atmospheric air travelling horizontally at a speed of about 1 to 200 feet per second. More preferably, confetti blaster 100 is used with confetti which is entrained by atmospheric air travelling horizontally at a speed of about 5 to about 50 feet per second.

Effective conditions for entraining confetti include atmospheric air of about one atmosphere pressure and about ambient temperature travelling at a speed within the above described ranges. Effective conditions for transporting confetti include atmospheric air of about one atmosphere pressure and about ambient temperature travelling at a relatively faster speed than required for entraining the same confetti; preferably, about twice as fast or more.

For the present purposes, "entrain," means carry away or drag after in a horizontal direction by a fluid stream travelling generally horizontally with respect to the earth. For the present purposes, "transport" means carry away in an upward direction relative to the earth. For example, fallen tree leaves sliding along or scudding over the surface of the ground under the influence of a wind are entrained. Even if this same wind travels upwardly, it does not necessarily have sufficient speed to carry the leaves upwardly. In contrast, wind, which is capable of transporting leaves, is capable of entraining the same leaves.

For operation, confetti blaster 100 is assembled substantially as depicted in FIG. 1. Confetti must be present in feed box 10. A confetti barrage is initiated by opening the shut-off valve at siphon tube 72, and employing throttling valve 76 to control a desired rate of motive gas to eductor 60. Throttling valve 76 is progressively opened until a flurry of confetti is ejected by eductor 60, after which throttling valve 76 is adjusted for optimum effect. Barrage distances of up to about 200 feet, and loft of up to about 80 feet, are feasible. Confetti discharge rates of about 1 to about 50 pounds per minute may be achieved. If denser coverage of the target area is desired, several confetti blasters may be discharged simultaneously.

While a few, preferred embodiments of the invention have been described above, those of ordinary skill in the art will recognize that any or all of these embodiments may be modified without departing from the spirit and scope of the invention. The preferred embodiments described above are to be considered as illustrative and not restrictive, the scope of the invention being indicated by the appended claims.

That which is claimed is:

1. A confetti blaster useful for delivering a barrage of confetti, which comprises:

an air mover capable of operating at a predetermined volumetric capacity and degree of vacuum, the air mover defining a low pressure inlet and an outlet;

a wall defining and substantially surrounding a vertically-oriented transport zone in pneumatic communication with the low pressure inlet, and defining an atmospheric air inlet situated and sized to produce a substantially vertical flow of air through the transport zone at conditions effective to transport confetti; and a wall defining and substantially surrounding a horizontally-oriented entrainment zone in pneumatic communication with the low pressure inlet, and defining an atmospheric air inlet situated and sized to produce a substantially horizontal flow of air through the transport zone at conditions effective to entrain confetti.

2. The confetti blaster of claim 1 in which the air mover is an eductor.

3. The confetti blaster of claim 2 in which the motive gas is carbon dioxide.

4. The confetti blaster of claim 1 in which the air mover is incrementally rotatable relative to the horizontal container wall.

5. A confetti blaster useful for delivering a barrage of confetti, which comprises:

a feed box having an inlet end, an outlet end opposite the inlet end, opposite sides, a top, and a bottom, the feed box defining a transport air inlet port adjacent the outlet end and an entrainment air inlet port adjacent the inlet end; and an air mover capable of operating at a predetermined volumetric capacity and degree of vacuum mounted on the top and adjacent the outlet end and including a low pressure inlet;

wherein the transport air inlet port adjacent the outlet end and the entrainment air inlet port are in pneumatic communication with the low pressure inlet, the transport air inlet is situated and sized to produce a substantially vertical flow of air through the transport zone at conditions effective to transport confetti, and the entrainment air inlet is situated and sized to produce substantially horizontal flow of air through the transport zone at conditions effective to entrain confetti.

6. The confetti blaster of claim 5 in which the feed box defines a charging port recloseably sealed by a lid, and the lid is pivotally attached to the top of the feed box by a hinge.

7. The confetti blaster of claim 6 in which the lid includes a limiting plate which projects from the lid and extends beyond the hinge, so that raising the lid lowers the limiting plate into the feed box to limit the volume of confetti which may be loaded into the feed box.

8. The confetti blaster of claim 5 in which the air mover is removably mounted on the top of the feed box.

9. The confetti blaster of claim 8 which further comprises a travelling cover for mounting on the top of the feed box when the eductor is removed.

10. The confetti blaster of claim 9 in which the feed box with the travelling cover mounted nests against an essentially identical feed box, so that transportation of the pair of feed boxes is facilitated.

11. The confetti blaster of claim 9 in which the travelling cover includes wheels to facilitate moving the feed box.

12. The confetti blaster of claim 5 in which the inlet end is removably attached to the feed box, and the eductor is of suitable size and shape for placing inside the feed box to facilitate transportation of the feed box and the eductor.

13. A confetti blaster useful for delivering a barrage of confetti, which comprises:

a feed box having an inlet end defining an entrainment air inlet port, an outlet end opposite the inlet end, a top defining a charging port, and a bottom defining a transport air inlet port;

a lid for recloseably sealing the charging port;

a hinge which pivotally attaches the lid to the top;

a limiting plate which projects from the lid and extends beyond the hinge box, so that raising the lid lowers the limiting plate into the feed box to limit the volume of confetti which may be loaded into the feed box; and an eductor capable of operating at a predetermined volumetric capacity and degree of vacuum, the eductor mounted on or adjacent the top, the eductor mounted on or adjacent the outlet end; and the eductor defining a motive gas inlet and a low pressure inlet;

wherein the entrainment air inlet port and the transport air inlet port are in pneumatic communication with the low pressure inlet, the transport air inlet is situated and sized to produce a substantially vertical flow of air through the transport zone at conditions effective to transport confetti, and the entrainment air inlet is situated and sized to produce substantially horizontal flow of air through the transport zone at conditions effective to entrain confetti.

14. The confetti blaster of claim 13 in which the motive gas is carbon dioxide.

15. The confetti blaster of claim 13 in which the feed box defines a charging port recloseably sealed by a lid, and the lid is pivotally attached to the top of the feed box by a hinge.

16. The confetti blaster of claim 15 in which the lid includes a limiting plate which projects from the lid and extends beyond the hinge, so that raising the lid lowers the limiting plate into the feed box to limit the volume of confetti which may be loaded into the feed box.

17. The confetti blaster of claim 13 in which the eductor air mover is removably mounted on the top of the feed box, and incrementally rotatable relative to the feed box.

18. A method for delivering a barrage of confetti, which method comprises:

passing confetti into an entrainment zone, which is in pneumatic communication with the low pressure inlet of an air mover capable of operating at a predetermined volumetric capacity and degree of vacuum;

passing a first stream of atmospheric air into the entrainment zone to maintain in the entrainment zone conditions effective to entrain the confetti;

passing an effluent stream from the entrainment zone and a second stream of atmospheric air into a generally vertically oriented transport zone to maintain in the entrainment zone conditions effective to entrain the confetti; and maintaining the low pressure inlet at the predetermined degree of vacuum.

19. The method of claim 18 which further comprises controlling the flow rate of the first stream by use of a restriction orifice of fixed and predetermined dimensions.

20. The method of claim 18 which further comprises controlling the flow rate of the second stream by use of a restriction orifice of fixed and predetermined dimensions.

* * * * *